US008749174B2

(12) United States Patent
Angeles

(10) Patent No.: US 8,749,174 B2
(45) Date of Patent: Jun. 10, 2014

(54) LOAD CURRENT MANAGEMENT CIRCUIT

(75) Inventor: Christian Pura Angeles, San Jose, CA (US)

(73) Assignee: Power Integrations, Inc., San Jose, CA (US)

( * ) Notice: Subject to any disclaimer, the term of this patent is extended or adjusted under 35 U.S.C. 154(b) by 476 days.

(21) Appl. No.: 13/223,080

(22) Filed: Aug. 31, 2011

(65) Prior Publication Data

US 2013/0049622 A1 Feb. 28, 2013

(51) Int. Cl.
*H05B 37/02* (2006.01)

(52) U.S. Cl.
USPC ..... 315/307; 315/219; 315/308

(58) Field of Classification Search
USPC ..... 315/307, 308, 291, DIG. 4, 193, 185 R, 315/246, 276, 219, 224
See application file for complete search history.

(56) References Cited

U.S. PATENT DOCUMENTS 6,963,175 B2 * 11/2005 Archenhold et al. ..... 315/291
2011/0241557 A1 * 10/2011 Grotkowski et al. ..... 315/246
2012/0286679 A1 * 11/2012 Liu ..... 315/193

* cited by examiner

*Primary Examiner* — David H Vu
(74) *Attorney, Agent, or Firm* — Blakely Sokoloff Taylor & Zafman LLP

(57) ABSTRACT

A circuit includes a switching power converter and a load current management circuit. The switching power converter provides a first current that varies between a first current value and a second current value in response to a dimming control signal. The load current management circuit provides a second current that varies between the second current value and a third current value in response to the dimming control signal. The second current varies in accordance with the first current. For example, the second current increases as the first current decreases and the second current decreases as the first current increases. In one example, the second current value corresponds to a required minimum load current for the power converter to regulate an output voltage.

20 Claims, 8 Drawing Sheets

LOAD CURRENT MANAGEMENT CIRCUIT

FIELD

This disclosure relates generally to power converters, and more specifically to power converters utilized with light emitting diode (LED) lamps.

BACKGROUND

Electronic devices use power to operate. A switched mode power converter is commonly used to power such electronic devices due to its high efficiency, small size, and low weight. Conventional wall sockets provide a high voltage alternating current. A switching power converter converts a high voltage alternating current (ac) input to provide a regulated direct current (dc) output using an energy transfer element. Switching power converters typically include a power converter controller. The power converter controller provides output regulation by sensing the output and controlling the regulated dc output using a closed loop. During operation, a switch is utilized to provide the desired output by varying the duty cycle (typically the ratio of the on time of the switch to the total switching period) of the switch in a switched mode power converter (also referred as a switching power supply or a switched mode power supply).

In lighting applications, LED lamps are quickly replacing traditional incandescent lamps due in part to the lower power consumption and longer lifetime of LED lamps. In general, LED lamps require a regulated power converter to provide a regulated current and voltage from the ac power line. LEDs are generally current driven devices and the brightness of an LED lamp is proportional to the amount of current provided to the LED lamp. In general, the more current flowing through the LED lamp corresponds to a brighter LED lamp. As such, dimming may be accomplished by varying the amount of current provided the LED lamp.

As noted above, power converters may use a controller to provide output regulation to an electrical device (such as an LED lamp) by sensing and controlling the output of the power converter in a closed loop. More specifically, the controller is coupled to a sensor that provides feedback information about the output of the power converter in order to regulate the output quantity delivered to the LED lamp (also referred to as a load). The controller regulates the output quantity delivered to the load by controlling a switch to turn on and off in response to the feedback information from the sensor to transfer energy pulses to the power converter output from a source of input power such as a power line. For LED lamps, the power converter regulates the output current to the LED lamp. For dimming applications, a dimming control signal representative of how much the power converter should dim the LED lamp is provided to the power converter. As mentioned above, dimming may be accomplished by varying the amount of current provided the LED lamp. As such, the dimming control signal can modify the feedback information to subsequently lower the output current delivered to an LED lamp and thus dim the LED lamp.

BRIEF DESCRIPTION OF THE DRAWINGS

The present disclosure is illustrated by way of example and is not limited by the accompanying figures, in which like references indicate similar elements. Elements in the figures are illustrated for simplicity and clarity and have not necessarily been drawn to scale.

DETAILED DESCRIPTION

Figure 1:
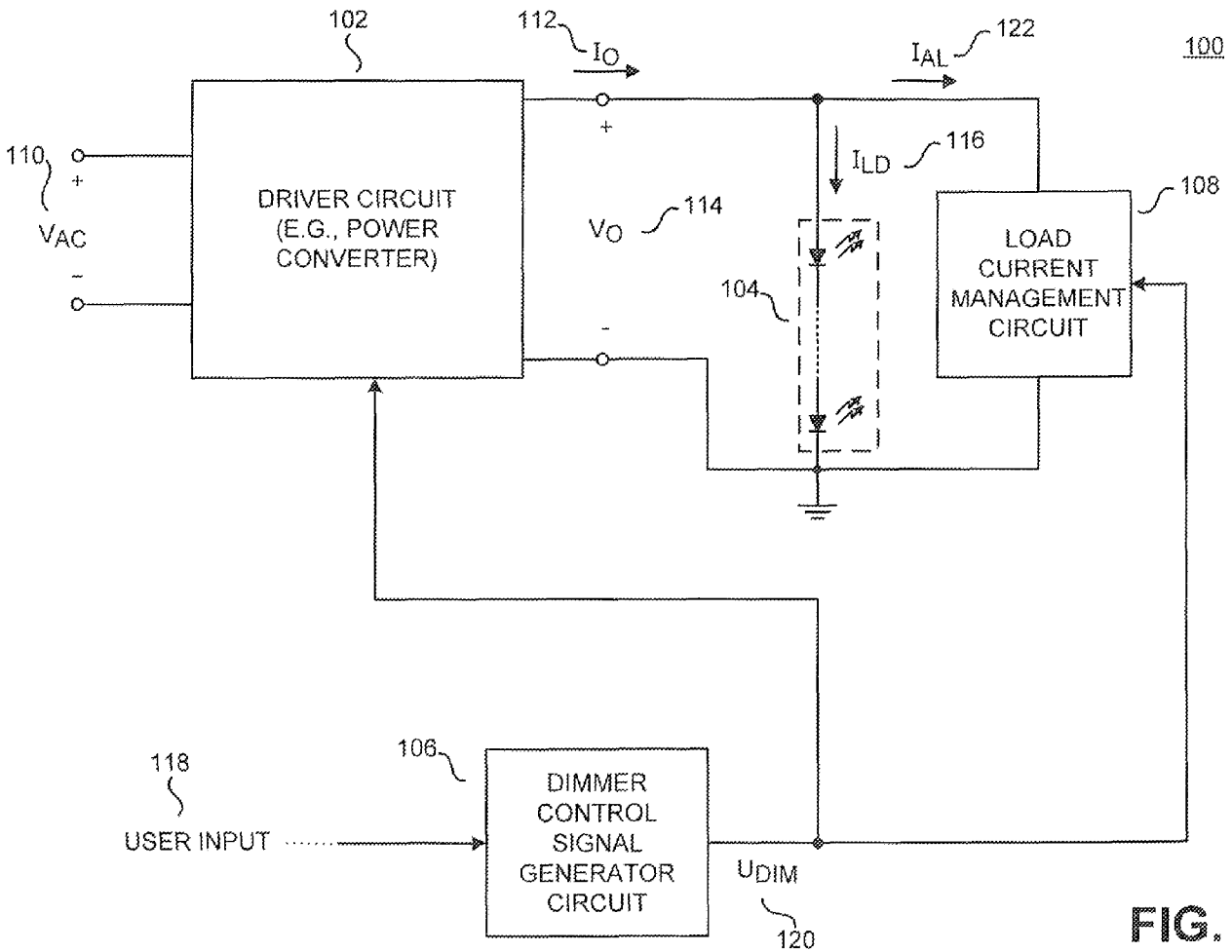
FIG. 1 is an example functional block diagram of a lighting system with a load current management circuit in accordance with the present disclosure.

In the following description, numerous specific details are set forth in order to provide a thorough understanding of the present invention. It will be apparent, however, to one having ordinary skill in the art that the specific detail need not be employed to practice the present invention. In other instances, well-known materials or methods have not been described in detail in order to avoid obscuring the present invention.

Reference throughout this specification to "one embodiment", "an embodiment", "one example" or "an example" means that a particular feature, structure or characteristic described in connection with the embodiment or example is included in at least one embodiment of the present invention. Thus, appearances of the phrases "in one embodiment", "in an embodiment", "one example" or "an example" in various places throughout this specification are not necessarily all referring to the same embodiment or example. Furthermore, the particular features, structures or characteristics may be combined in any suitable combinations and/or subcombinations in one or more embodiments or examples. Particular features, structures or characteristics may be included in an integrated circuit, an electronic circuit, a combinational logic circuit, or other suitable components that provide the described functionality. In addition, it is appreciated that the figures provided herewith are for explanation purposes to persons ordinarily skilled in the art and that the drawings are not necessarily drawn to scale.

As used herein, the term "circuit" can include an electronic circuit, one or more processors (e.g., shared, dedicated, or group of processors such as but not limited to microprocessors, digital signal processors, or central processing units) and memory that execute one or more software or firmware programs, combinational logic circuits, an application specific integrated circuit, and/or other suitable components that provide the described functionality. Additionally, as will be appreciated by those of ordinary skill in the art, one or more circuits can be combined in an integrated circuit if desired.

Furthermore, the term "signal" may refer to one or more currents, one or more voltages, or a data signal.

As noted above, power converters can use a controller to provide output regulation to an electrical device or load (such as an LED lamp for example) by sensing and controlling the output of the power converter in a closed loop. More specifically, the controller can be coupled to a sensor that provides feedback information about the output of the power converter in order to regulate the output quantity delivered to the LED lamp (also referred to as a load). The controller regulates the output quantity delivered to the load by controlling a switch to turn on and off in response to the feedback information from the sensor to transfer energy pulses to the power converter output from a source of input power such as a power line.

In LED lighting applications, the power converter regulates the output current to the LED lamp. In lighting dimming applications, a dimming control signal representative of how much the power converter should dim the LED lamp is provided to the power converter. As mentioned above, dimming may be accomplished by varying the amount of current provided the LED lamp. The dimming control signal can modify the feedback information to subsequently lower the output current delivered to an LED lamp and thus dim the LED lamp.

There are many types of dimming for lighting applications, such as, for example, triac dimming, pulse width modulation (PWM) analog dimming, and PWM digital dimming. However, complete dimming of the LED lamp typically cannot occur because the power converter has to maintain a minimum output power threshold. Once the minimum output power threshold is reached, the power converter goes into auto-restart or similar controller mode (i.e., burst mode at substantially no load condition) resulting in output current fluctuations in the LED load which leads to flickering of the light output. As such, in LED dimming applications, the LED lamp cannot completely dim due in part to the minimum output power requirement of the power converter.

In embodiments of the present disclosure, a load current management circuit (e.g., an active load) is provided at the output of the power converter. The load current management circuit provides an active load current that offsets the minimum output current of the power converter. In particular, an active load current offsets the output current of the power converter during dimming and without reducing the efficiency of the power converter during non-dimming operation. The active load current is a variable current that is controlled by the dimming control signal. The load current management circuit is coupled to the power converter such that the current flowing though the load is the difference between the output current of the power converter and the active load current. As such, the current through the LED lamp can fall to zero and complete dimming can be achieved.

Referring now to FIG. 1, an example functional block diagram of a system 100 according to the present disclosure is depicted. The system 100 includes a driver circuit 102 (e.g., a switching power converter), a load 104, a dimmer control signal generator circuit 106, and a load current management circuit 108. Further shown in FIG. 1 are ac input voltage VAC 110, an output current IO 112, an output voltage VO 114, a load current ILD 116, a user input 118, a load current control signal UDIM 120 (e.g., a dimming signal), and an active load current IAL 122. As shown, in this example, the load 104 comprises a light emitting diode (LED) array or LED lamp. While embodiments of the present disclosure are discussed with regards to lighting applications, it should be appreciated that many applications may utilize discussed embodiments.

The driver circuit 102 is coupled to the load 104. As shown, the driver circuit 102 is coupled to receive the ac input voltage 110 and, in response to the ac input voltage 110, provides an output current IO 112 and output voltage VO 114 to the load 104. In this example, the current provided to load 104 is denoted as the load current ILD 116. In one embodiment, the load 104 is an LED array (also referred to as an LED lamp) and driver 102 circuit is an LED driver such as a switching power converter. The driver circuit 102 is further coupled to dimmer control signal generator 106 and receives a user input 118. In response to the user input 118, dimmer control signal generator 106 generates the dimming control signal UDIM 120 (e.g., a dimming signal) which is received by the driver circuit 102. In one embodiment, the dimming control signal UDIM 120 provides information regarding how much dimming is desired.

In addition, the load current management circuit 108 is coupled to dimmer control signal generator 106 and receives dimming control signal UDIM 120. The load current management circuit 108 is coupled across the load 104 and produces active load current IAL 122 in response to the dimming control signal UDIM 120. The load current management circuit 108 is coupled to the load 104 such that the load current 116 is the difference between the output current IO 112 and the active load current IAL 122, or mathematically: $I_{LD}=I_O-I_{AL}$.

During operation, the driver circuit 102 provides output power to the load 104 from an unregulated input such as ac the input voltage VAC 102. The dimmer control signal generator circuit 106 produces the dimming control signal UDIM 120 in response to the user input 118. The dimming control signal UDIM 120 is representative of how much the driver 102 should reduce current to the load 104 (e.g., how much the LED should be dimmed) and can be either a current signal or a voltage signal. As mentioned above, in lighting applications, the brightness of the load 104 can be controlled by varying the amount of current provided the load 104. In other words, by varying the output current IO 112 (and therefore load current ILD 116), the driver circuit 102 can vary the brightness (i.e., dim) the load 104 in lighting applications. The driver 102 varies the output current 112 in response to the dimmer control signal UDIM 120. The more dimming desired corresponds to a smaller the value of the output current IO 112. In other words, the output current 112 decreases with greater percentages of dimming (the amount of dimming desired).

The load current management circuit 108 provides the active load current IAL 122 in response to the dimming control signal UDIM 120. As noted above, a minimum current threshold may exist for the output current IO 112 so that the power converter does not go into auto-restart mode and can regulate the output current and/or voltage. As such, dimming of the load 104 may not be fully achieved unless the active load current IAL 122 is utilized to offset the minimum current threshold. The active load current IAL 122 is a variable current controlled by the dimming control signal UDIM 120. The more dimming desired corresponds to a larger value of the active load current IAL 122. In other words, the active load current IAL 122 increases with greater percentages of dimming (the amount of dimming wanted). In one embodiment, at one hundred percent dimming of the active load current IAL 122 is approximately equal to the minimum current threshold of the output current IO 112.

The load current management circuit 108 is coupled such that the load current 116 is substantially equal to the difference between the output current IO 112 and active load current IAL 122, or mathematically: $I_{LD}=I_O-I_{AL}$. The active load current IAL 122 acts as an offset to the output current IO 112 such that one hundred percent dimming can be achieved. As will be further explained, the active load current IAL 122 increases as the output current IO 112 decreases until the output current IO 112 and the active load current IAL 122 are substantially equal.

In lighting applications, many types of known dimming control signals can be used in accordance with embodiments of the present disclosure. For example, in one embodiment, the dimming control signal UDIM 120 can be a pulse width modulated (PWM) analog dimming control signal. When using PWM analog dimming control, the dimming control signal UDIM 120 can be a voltage signal that is linearly proportional to the percentage of dimming. As such, the voltage of the dimming control signal UDIM 120 corresponds to the percentage of dimming.

In another embodiment, the dimming control signal UDIM 120 can be a PWM digital dimming control signal. When using PWM digital dimming control, the dimming control signal UDIM 120 can be a rectangular pulse waveform with varying lengths of logical high and logical low sections. The duty ratio of the dimming control signal UDIM 120 corresponds to the percentage of dimming. More specifically, the duty ratio is the ratio of length of the logical high sections to the total period (the length of the logical high section plus the logical low section). In one example, a duty ratio of one can correspond to no dimming while a duty ratio of zero can correspond to complete dimming (100% dimming). In another example, a duty ratio of one can correspond to complete dimming while a duty ratio of zero can correspond to no dimming. The relationship between the duty ratio to percentage of dimming is a linear relationship.

In a further embodiment, the dimming control signal UDIM 120 can be a phase dimming signal typically associated with triac dimmers. Triac dimmer circuits typically remove a portion of the ac input voltage to limit the amount of voltage and current supplied to a load. This is known as phase dimming because it is often convenient to designate the position of the missing voltage in terms of a fraction of the period of the ac input voltage measured in degrees. In general, the ac input voltage is a sinusoidal waveform and the period of the ac input voltage is referred to as a full line cycle. As such, half the period of the ac input voltage is referred to as a half line cycle. An entire period has 360 degrees, and a half line cycle has 180 degrees. Typically, the phase angle is a measure of how many degrees (from a reference of zero degrees) of each half line cycle the dimmer circuit removes. As such, removal of half the ac input voltage in a half line cycle by the triac dimmer circuit corresponds to a phase angle of 90 degrees. In another example, removal of a quarter of the ac input voltage in a half line cycle may correspond to a phase angle of 45 degrees.

When phase dimming is used, the dimming control signal UDIM 120 can be representative of the how many degrees the dimmer circuit removes (and hence the amount of dimming wanted). In this example, the dimmer control signal generator circuit 106 includes a phase detector which can either generate a PWM digital dimming signal or a PWM analog dimming signal from the phase angle.

Figure 2:
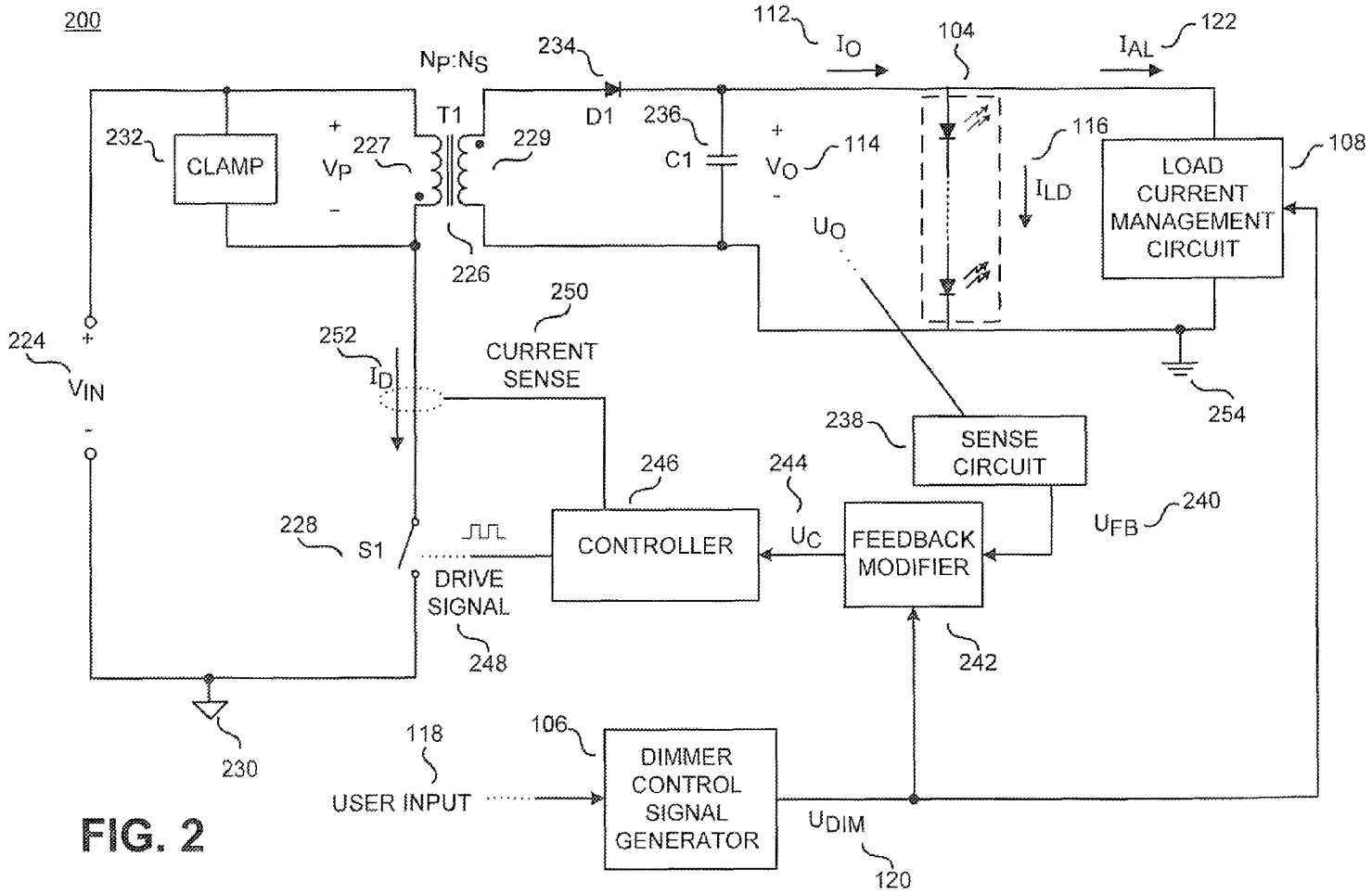
FIG. 2 is an example functional block diagram of a lighting system utilizing a power converter with the load current management circuit.

Referring now to FIG. 2, an example lighting system 200 using a power converter as the driver circuit 102 is depicted. Shown in FIG. 2 is an input VIN 224, an energy transfer element T1 226, a primary winding 227 of energy transfer element T1 226, a secondary winding 229 of energy transfer element T1 226, a switch S1 228, an input return 230, a clamp circuit 232, a rectifier D1 234, an output capacitor C1 236, an output quantity UO, a sense circuit 238, a feedback signal UFB 240, a feedback modifier 242, a controller input UC 244, a controller 246, a drive signal 248, a current sense input signal 250, and switch current ID 252. The example switching power converter illustrated in FIG. 2 is configured generally as a flyback regulator, which is one example of a switching power converter topology that may benefit from the teachings of the present disclosure. However, it is appreciated that other known topologies and configurations of switching power converter regulators may also benefit from the teachings of the present disclosure.

The switching power converter provides output power to the load 104, such as an LED lamp for example, from an unregulated input VIN 224. In one embodiment, the input VIN 224 is a rectified and filtered ac line voltage (such as ac input voltage VAC 110 shown in FIG. 1). In another embodiment, the input VIN 224 is a dc input voltage. The input VIN 224 is coupled to energy transfer element T1 226. In some embodiments, the energy transfer element T1 226 can be a coupled inductor. In other embodiments, the energy transfer element T1 226 can be transformer.

As shown, in this example, the energy transfer element T1 226 includes two windings, a primary winding 227 and secondary winding 229. In this example, NP and NS represent the number of turns for the primary winding 227 and secondary winding 229, respectively. The primary winding 227 can be considered an input winding and secondary winding 229 can be considered an output winding. The primary winding 227 is coupled to the active switch S1 228, which is coupled to the input return 230. In addition, the clamp circuit 232 is coupled across the primary winding 227 of the energy transfer element T1 226.

The secondary winding 229 of the energy transfer element T1 226 is coupled to the rectifier D1 234. In this example, the rectifier D1 234 is depicted as a diode and the secondary winding 229 is coupled to the anode end of the diode. However, in some embodiments the rectifier D1 234 can be a transistor used as a synchronous rectifier or other suitable circuit. As shown, both the output capacitor C1 236 and the load 104 are coupled to the rectifier D1 234. In this example, the rectifier D1 234 is depicted as a diode and both the output capacitor C1 236 and the load 104 are coupled to the cathode end of the diode. An output is provided to the load 104 and can be provided as either the output voltage VO 114, the output current IO 112, or a combination of the two. Further coupled to the rectifier D1 234 is the load current management circuit 108. As shown, in this example, the load current management circuit 108 is coupled to the cathode end of the diode. The load current management circuit 108 receives the dimming control signal UDIM 120 and provides the active load current IAL 122 based thereon.

In addition, the switched mode power converter comprises circuitry to regulate the output that is shown as output quantity UO. In general, the output quantity UO is either the output voltage VO 114, the output current IO 112, or a combination of the two. A sense circuit 238 is coupled to sense the output quantity UO. In one embodiment, the feedback circuit 120 can sense the output quantity UO from an additional winding of the energy transfer element T1 226. In another embodiment, the sense circuit 238 can sense the output quantity UO from the output of the power converter.

The feedback modifier 242 is coupled to the sense circuit 238 and receives a feedback signal UFB 240 from the sense circuit 238. The feedback modifier 242 is further coupled to the dimmer control signal generator 106 and receives the dimming control signal UDIM 120. Based on the feedback signal UFB 240 and dimming control signal UDIM 120, the feedback modifier 242 provides the controller input UC 244 to the controller 246.

The controller 246 comprises several terminals. At one terminal, the controller receives the controller input UC 244 from the feedback modifier 242. The controller 246 further includes terminals for the current sense input 250 and the drive signal 248. The current sense input 250 provides information regarding the sensed switch current ID 252 in switch S1 228. In addition, the controller 246 provides the drive signal 248 to the switch S1 228 to control various switching parameters. Examples of such parameters may include switching frequency, switching period, duty cycle, or respective on and off times of the switch S1 228.

In the example of FIG. 2, the input voltage VIN 224 is positive with respect to the input return 230, and the output voltage VO 114 is positive with respect to the output return 254. As shown, in this example, galvanic isolation is used between the input return 230 and the output return 254 because input return 230 and output return 254 are designated by different symbols. In other words, a dc voltage applied between the input return 230 and the output return 254 will produce substantially zero current. As such, circuits electrically coupled to the primary winding 227 are galvanically isolated from circuits electrically coupled to the secondary winding 229.

During operation, the power converter of FIG. 2 provides output power to the load 104 from the unregulated input VIN 224. The power converter utilizes the energy transfer element T1 226 to transform the voltage from the VIN 224 between the primary 227 and secondary 229 windings. The clamp circuit 232 is coupled to the primary winding 227 of the energy transfer element T1 226 to limit the maximum voltage on the switch S1 228. The switch S1 228 is opened and closed in response to the drive signal 248 received from the controller 244. In the example of FIG. 2, the switch S1 248 controls the current ID 252 in response to controller 246 to meet a specified performance of the power converter. In one embodiment, the switch S1 248 controls a current ID 252 to provide a specific output current UO 112 to the load 104. In some embodiments, the switch S1 228 can be a transistor and the controller 246 can include integrated circuits and/or discrete electrical components. In one embodiment, the controller 246 and switch S1 228 are included together into a single integrated circuit. In one example, the integrated circuit is a monolithic integrated circuit. In another example, the integrated circuit is a hybrid integrated circuit.

The operation of switch S1 228 also produces a time varying voltage VP between the ends of primary winding 227. By transformer action, a scaled replica of the voltage VP is produced between the ends of secondary winding 229, the scale factor being the ratio that is the number of turns of secondary winding 227 divided by the number of turns of primary winding 229. The switching of switch S1 228 also produces a pulsating current at the rectifier D1 234. The current in rectifier D1 234 is filtered by output capacitor C1 236 to produce a substantially constant output voltage VO 114, output current IO 112, or a combination of the two at the load 104.

The sense circuit 238 senses the output quantity UO to provide the feedback signal UFB 240 to the feedback modifier 242. The feedback modifier 242 receives the dimming control signal UDIM 120. The feedback modifier 242 modifies the feedback signal UFB 240 in based on the dimming control signal UDIM 120. In one embodiment, the dimming control signal UDIM 120 can be subtracted from the feedback signal UFB 240 such that the controller 246 will subsequently dim the load 104. The dimming control signal UDIM 120 may modify the feedback current in a variety of ways. For example, the load current signal UDIM 120 may be multiplied, added, subtracted, divided, or any combination of the above to the feedback signal UFB 240. In operation, the controller 246 regulates the output current 112 in response to the controller input UC 244, which is based on the feedback signal UFB 240 and the dimming control signal UDIM 120. The more dimming desired corresponds to a smaller the value of the output current IO 112. In other words, the output current 112 decreases with greater percentages of dimming (the amount of dimming wanted).

As shown, in this example, the controller 246 receives the output of feedback modifier 242 (controller input UC 244) and also receives the current sense input 250 which relays the sensed switch current ID 252 in the switch S1 228. The switch current ID 252 can be sensed in a variety of known ways, such as for example the voltage across a discrete resistor or the voltage across the transistor when the transistor is conducting.

In addition, the active load 108 produces the active load current IAL 122 in response to the dimming control signal UDIM 120. As noted above, a minimum current threshold may exist for the output current IO 112 so that the power converter does not go into auto-restart mode and can regulate the output current and/or voltage. As such, dimming of the load 104 may not be fully achieved unless the active load current IAL 122 is utilized to offset the minimum current threshold. The active load current IAL 122 is a variable current controlled by the dimmer control signal UDIM 120 and the more dimming desired corresponds to a larger value of the active load current IAL 122. In other words, the active load current IAL 122 increases with greater percentages of dimming (the amount of dimming wanted). In one embodiment, at one hundred percent dimming the active load current IAL 122 is substantially equal to the minimum current threshold of the output current IO 112.

The load current management circuit 108 is coupled such that the load current 116 is substantially equal to the difference between the output current IO 112 and the active load current IAL 122, or mathematically: $I_{LD}=I_O-I_{AL}$. The active load current IAL 122 acts as an offset to the output current IO 112 such that one hundred percent dimming can be achieved. As will be further explained, the active load current IAL 122 increases as the output current IO 112 decreases until the output current IO 112 and the active load current IAL 122 are substantially equal.

Figure 3:
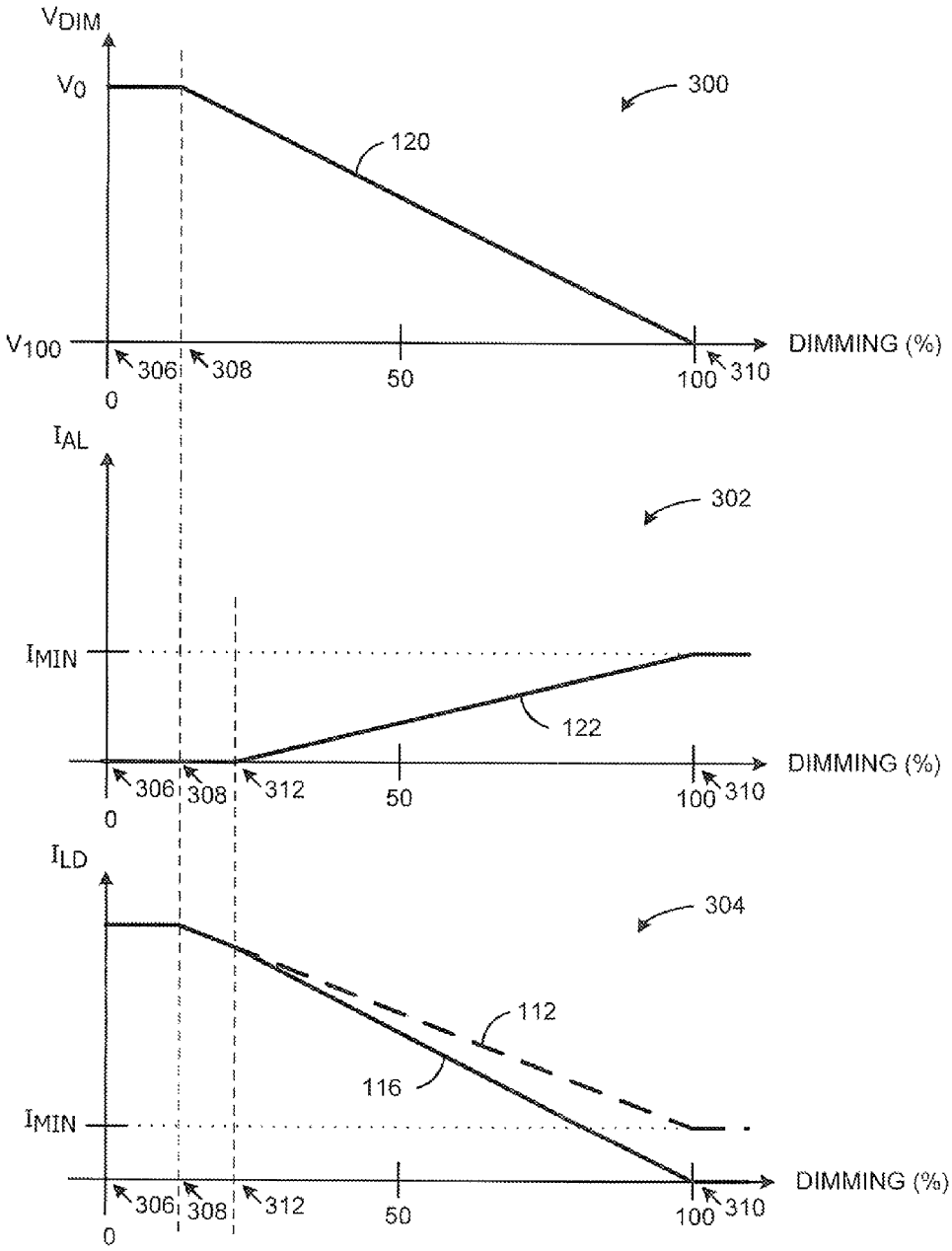
FIG. 3 depicts example waveforms of a dimming control signal and resultant waveforms in accordance with the present disclosure.

Referring now to FIG. 3, example waveforms of the dimming control signal UDIM 120 and resultant waveforms (i.e., the active load current IAL 122 and the load current ILD 116) are depicted. The dimming control signal UDIM 120 is depicted at 300, the active load current IAL 122 is depicted at 302, and the output current 112 IO and the load current ILD 116 are depicted at 304.

As shown at 300, the dimming control signal UDIM 120, which is represented as a voltage signal (VDIM) in this example, decreases in value as the desired dimming increases. More specifically, the dimming control signal UDIM 120 is at value V0, which designates that no dimming (e.g., zero percent dimming) of the load 104 is desired at time 306. At time 308, the dimming control signal UDIM 120 begins to decrease in response to the user input 118 until it reaches value V100, which designates maximum dimming (complete or one hundred percent) at time 310. In one embodiment, FIG. 3 illustrates the dimming control signal UDIM 120 linearly decreasing with percentage of dimming.

As shown, in response to the dimming control signal UDIM 120 decreasing, the active load current IAL 122 begins to linearly increase after the dimming control signal VDIM drops to a level corresponding to time 312. In another embodiment, the active load current IAL 122 begins to increase after a suitable time delay at time 312. The difference between the dimming control signal VDIM at time 308 and the dimming control signal VDIM at time 312 serves as a guard-band to ensure that the active load does not conduct at full brightness and thus does not reduce the converter efficiency when it is at zero percent dimming. For example, the dimming control signal VDIM at time 312 can be set to 90% of the maximum value of the dimming control signal VDIM. In the example of FIG. 3, the dimming control signal VDIM at time 312 can be set to 90% of value V0. As shown, the active load current IAL 122 increases until it reaches the minimum output current threshold of the power converter IMIN at time 310.

In addition, the output current IO 112 and the load current ILD 116 begin to linearly decrease at time 308 in response to the dimming control signal UDIM 120 decreasing. Between time 308 and time 312, the active load current IAL 122 is substantially zero and the output current IO 112 and the load current ILD 116 decrease at the same rate. As such, the output current IO 112 and the load current ILD 116 are substantially equal. At time 312, the load current ILD 116 begins to decrease at a greater rate than the output current IO 112. As shown, the output current IO 112 substantially reaches the minimum output current threshold of the power converter IMIN at time 310. As such, the driver circuit 102 (e.g., power converter) can maintain its minimum output current threshold and thus not enter into an auto restart mode or other protection mode. However, the load current ILD 116, which as noted above is a combination of the output current IO 112 and the active load current IAL 122, substantially reaches zero (or one hundred percent dimming) at time 310. Accordingly, current delivered to the load 104 is substantially zero and thus one hundred percent dimming can be achieved in lighting applications.

Figure 4A:
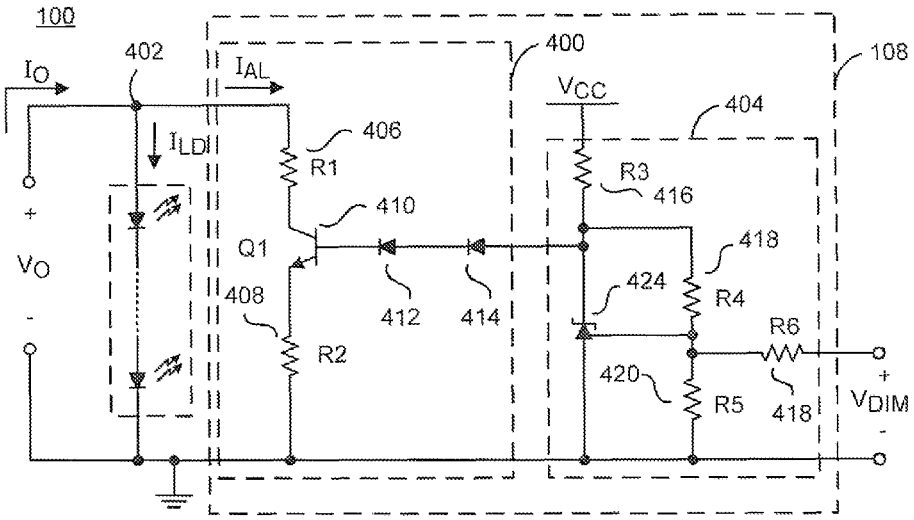
FIG. 4A is an example of the load current management circuit that can be utilized to correspond with the waveforms depicted in FIG. 3.

Referring now to FIG. 4A, an example of the load current management circuit 108 is depicted that can be used to correspond with the waveforms of FIG. 3. In this example, the load current management circuit 108 includes signal controlled current source 400 and an inverter circuit 404. The inverter circuit 404 provides an inverted voltage to the signal controlled current source 400 in response to the dimming control signal UDIM 120, which is a voltage in this example. In response to the inverted voltage, the signal controlled current source 400 provides the active load current IAL 122, which is combined with the output current IO 112 at node 402 to provide the load current ILD 116. As noted above, by combining the output current IO 112 and the active load current IAL 122, the load current ILD 116 can be decreased to substantially zero without the driver circuit 102 (e.g., switching power converter) going into an auto restart mode or similar controller mode (i.e., burst mode condition at substantially no load condition).

In this example, the signal controlled current source 400 includes a first resistance R1 406, a second resistance R2 408, and a transistor Q1 410, which is a bipolar junction transistor (BJT) in this example, substantially configured as shown. However, other transistors may be utilized. Optionally, the signal controlled current source 400 may include a first diode 412 and a second diode 414 substantially configured as shown. The first and second diodes 412, 414 are used to ensure that the minimum inverted voltage from the inverter circuit 404 does not exceed the turn-on threshold voltage of the signal controlled current source 400 during zero percent dimming. The first resistance R1 406 is used to reduce the dissipation on transistor Q1 410 and thus enable the use of smaller device package for transistor Q1 410. The second resistance R2 408 is selected such that the signal controlled current source 400 can deliver the minimum output current threshold IMIN during one hundred percent dimming. The signal controlled current source 400 provides a current in response to a voltage signal or a current signal.

The inverter circuit 404 includes a third resistance R3 416, a fourth resistance R4 418, a fifth resistance R5 420, a sixth resistance R6 422, and a shunt regulator 424 substantially configured as shown. In one example, the third resistance R3 416 can have a value of 4.3 kilo-ohms (kΩ) or other suitable value, the fourth resistance R4 418 can have a value of 100 kΩ or other suitable value, the fifth resistance R5 420 can have a value of 12.4 kΩ or other suitable value, and the sixth resistance R6 422 can have a value of 80.6 kΩ or other suitable value. The shunt regulator 424 can be any suitable shunt regulator known in the art such as National Semiconductor's LMV431 for example.

Figure 4B:
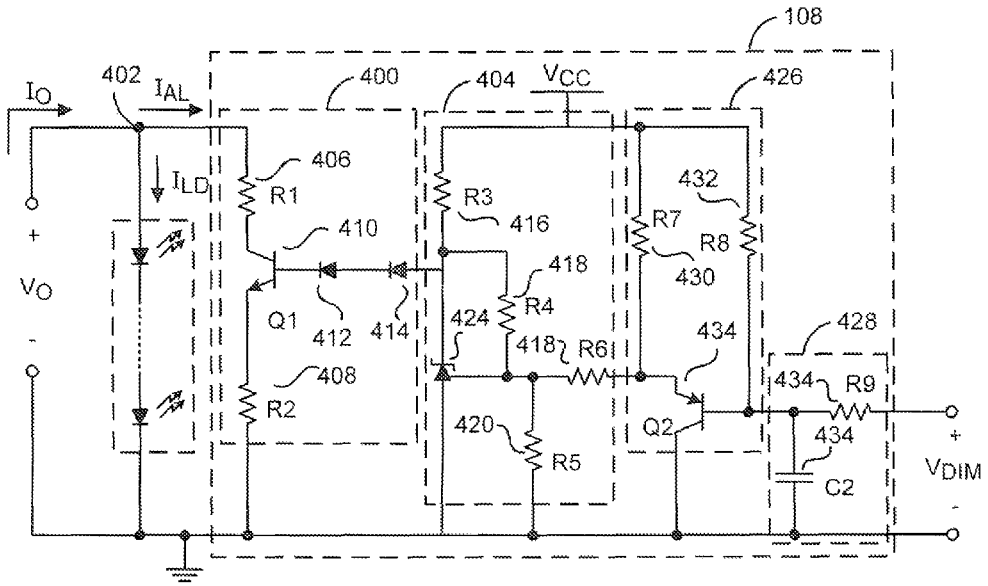
FIG. 4B is another example of the load current management circuit that can be utilized to correspond with the waveforms depicted in FIG. 3.

Referring now to FIG. 4B, another example of the load current management circuit 108 is depicted that can be used to correspond with the waveforms of FIG. 3. In this example, the load current management circuit 108 includes the signal controlled current source 400, the inverter circuit 404, a pull up circuit 426, and a filter 428. The filter 428 filters the dimming control signal UDIM 120, which is a voltage based dimming control signal (VDIM) in this example. The pull up circuit 426 ensures that the load current management circuit 108 is off when the dimming control signal VDIM is not present (i.e. the input of the load current management circuit 108 which receives the dimming control signal is open). This provides the option for a dimmer control signal generator 106 to not be utilized. When VDIM is not present, resistance R7 430 pulls the input to the inverter circuit 404 to VCC which in turn turns-off the signal controlled current source 400. When VDIM is present, transistor Q2 434 conducts and pulls the input to the inverter circuit 404 one diode drop above the VDIM input signal. The inverter circuit 404 provides an inverted voltage to the signal controlled current source 400 in response to the dimming control signal UDIM 120. In response to the inverted voltage, the signal controlled current source 400 provides the active load current IAL 122, which is combined with the output current IO 112 at node 402 to provide the load current ILD 116. As noted above, by combining the output current IO 112 and the active load current IAL 122, the load current ILD 116 can be decreased to substantially zero without the driver circuit 102 (e.g., switching power converter) going into an auto restart mode.

In this example, the pull up circuit 426 includes a seventh resistance R7 430, an eighth resistance R8 432, and a second transistor Q2 434 substantially configured as shown. In one example, the second transistor Q2 434 can be a BJT or other suitable transistor. In one example, the seventh resistance R7 430 can have a resistance of 10 kΩ or other suitable value and the eighth resistance R8 432 can have a resistance of 1 MΩ or other suitable value.

The filter 428 includes a ninth resistance R9 436 and a capacitance C2 438 substantially configured as shown. In one example, the ninth resistance R9 436 can have a resistance of 1 kΩ or other suitable value and the capacitance C2 438 can have a capacitance of 1 nF or other suitable value.

Figure 5:
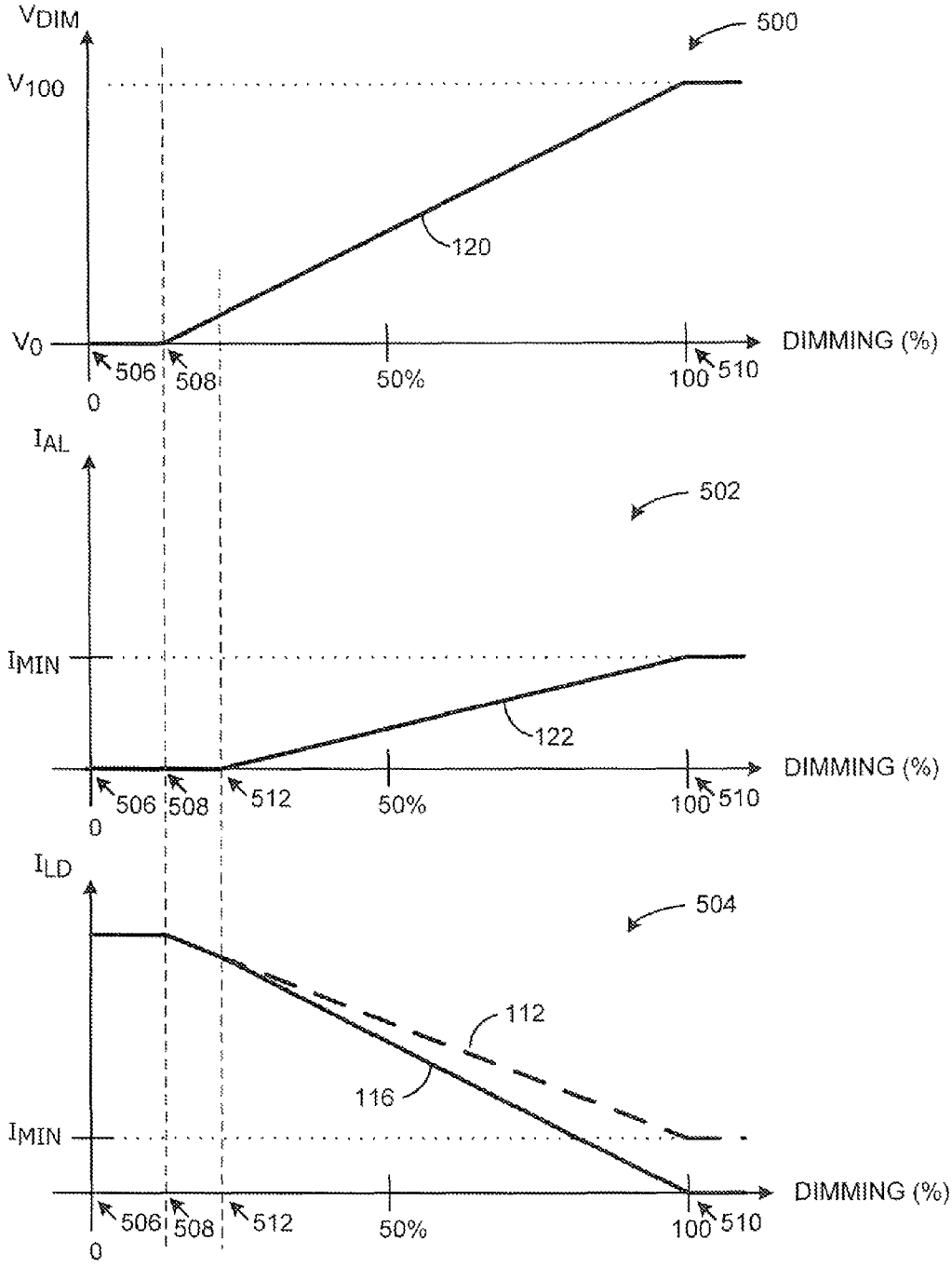
FIG. 5 depicts other example waveforms of a dimming control signal and resultant waveforms in accordance with the present disclosure.

Referring now to FIG. 5, example waveforms of the dimming control signal UDIM 120 and resultant waveforms (i.e., the active load current IAL 122 and the load current ILD 116) are depicted. The dimming control signal UDIM 120 is depicted at 500, the active load current IAL 122 is depicted at 502, and the output current IO 112 and the load current ILD 116 are depicted at 504.

As shown at 500, in this example, the dimming control signal UDIM 120 (which is represented as a voltage signal VDIM) increases in value as the desired dimming increases. More specifically, the dimming control signal UDIM 120 is at value VO, which designates that no dimming (e.g., zero percent dimming) of the load 104 is desired at time 506. At time 508, the dimming control signal UDIM 120 begins to increase in response to the user input 118 until it reaches value V100, which designates maximum dimming (complete or one hundred percent) at time 510. In one embodiment, FIG. 5 illustrates the dimming control signal UDIM 120 linearly increasing with percentage of dimming.

As shown, in response to the dimming control signal VDIM increasing, the active load current IAL 122 begins to linearly increase after a suitable delay at time 512. In another embodiment, the active load current IAL 122 begins to linearly decrease after the dimming control signal VDIM reaches a level that corresponds to time 512. The delay ensures that the active load does not conduct at full brightness and thus does not reduce the converter efficiency when it is at zero percent dimming condition. For example, VDIM at time 512 can be set to ten percent of the maximum value of VDIMt or other suitable value. In other words, VDIM at time 512 can be set to ten percent of the value V100. As shown, the active load current IAL 122 increases until it reaches the minimum output current threshold of the power converter IMIN at time 510.

In addition, the output current IO 112 and the load current ILD 116 begin to linearly decrease at time 508 in response to the dimming control signal UDIM 120 increasing. Between time 508 and time 512, the active load current IAL 122 is substantially zero and the output current IO 112 and the load current ILD 116 decrease at the same rate. As such, the output current IO 112 and the load current ILD 116 are substantially equal. At time 512, the load current ILD 116 begins to decrease at a greater rate than the output current IO 112. As shown, the output current IO 112 substantially reaches the minimum output current threshold of the power converter IMIN at time 510. As such, the driver circuit 102 (e.g., power converter) can maintain its minimum output current threshold and thus not enter into an auto restart mode. However, the load current ILD 116, which as noted above is a combination of the output current IO 112 and the active load current IAL 122, substantially reaches zero (or one hundred percent dimming) at time 510. Accordingly, current delivered to the load 104 is substantially zero and thus one hundred percent dimming can be achieved in lighting applications.

Figure 6:
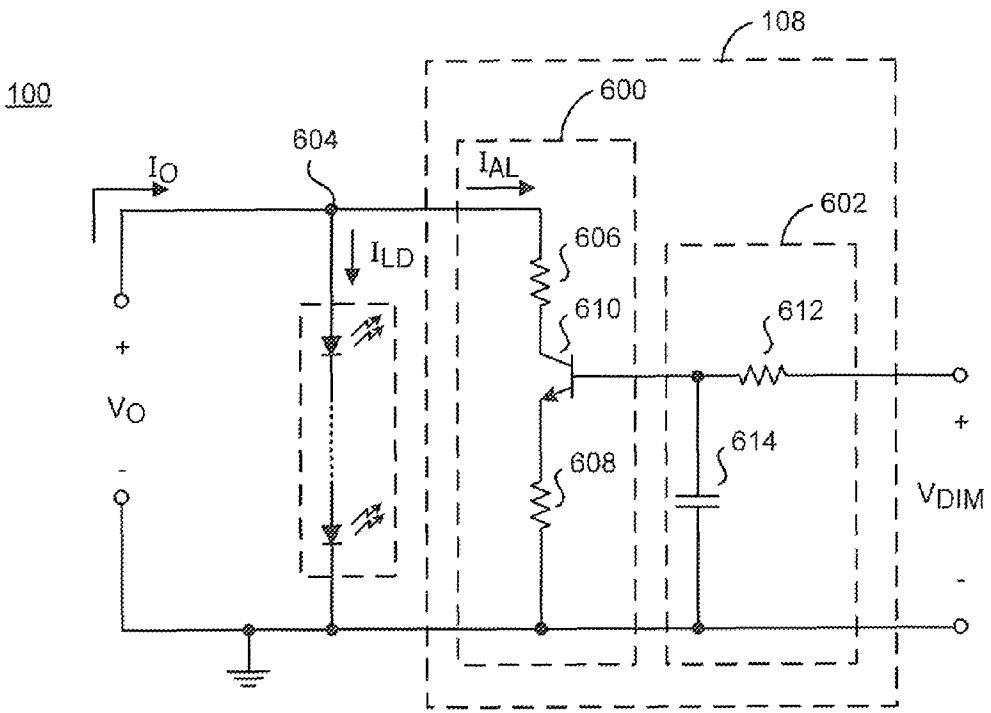
FIG. 6 is an example of the load current management circuit that can be utilized to correspond with the waveforms depicted in FIG. 5.

Referring now to FIG. 6, an example of the load current management circuit 108 is depicted that can be used to correspond with the waveforms of FIG. 5. In this example, the load current management circuit 108 includes signal controlled current source 600 and a filter 604. The filter 602 filters the dimming control signal UDIM 120, which is a voltage in this example. In response to the filtered voltage, the signal controlled current source 600 provides the active load current IAL 122, which is combined with the output current IO 112 at node 604 to provide the load current ILD 116. As noted above, by combining the output current IO 112 and the active load current IAL 122, the load current ILD 116 can be decreased to substantially zero without the driver circuit 102 (e.g., switching power converter) going into an auto restart mode or similar controller mode (i.e., burst mode at substantially no load condition).

In this example, the signal controlled current source 600 includes a first resistance 606, a second resistance 608, and a transistor 610, which is a BJT in this example, substantially configured as shown. In one example, the first resistance 606 is used to reduce the dissipation on transistor Q1 410 and thus enable the use of low power transistor 610 the second resistance 608 is selected such that the current source 600 can deliver the minimum output current threshold IMIN during 100% dimming condition. The signal controlled current source 600 provides a current in response to a voltage signal or a current signal.

The filter 602 includes a third resistance 612 and a capacitance 614 substantially configured as shown. In one example, the third resistance 612 can have a resistance of 1 kΩ or other suitable value and the capacitance 614 can have a capacitance of 1 nF or other suitable value.

Figure 7:
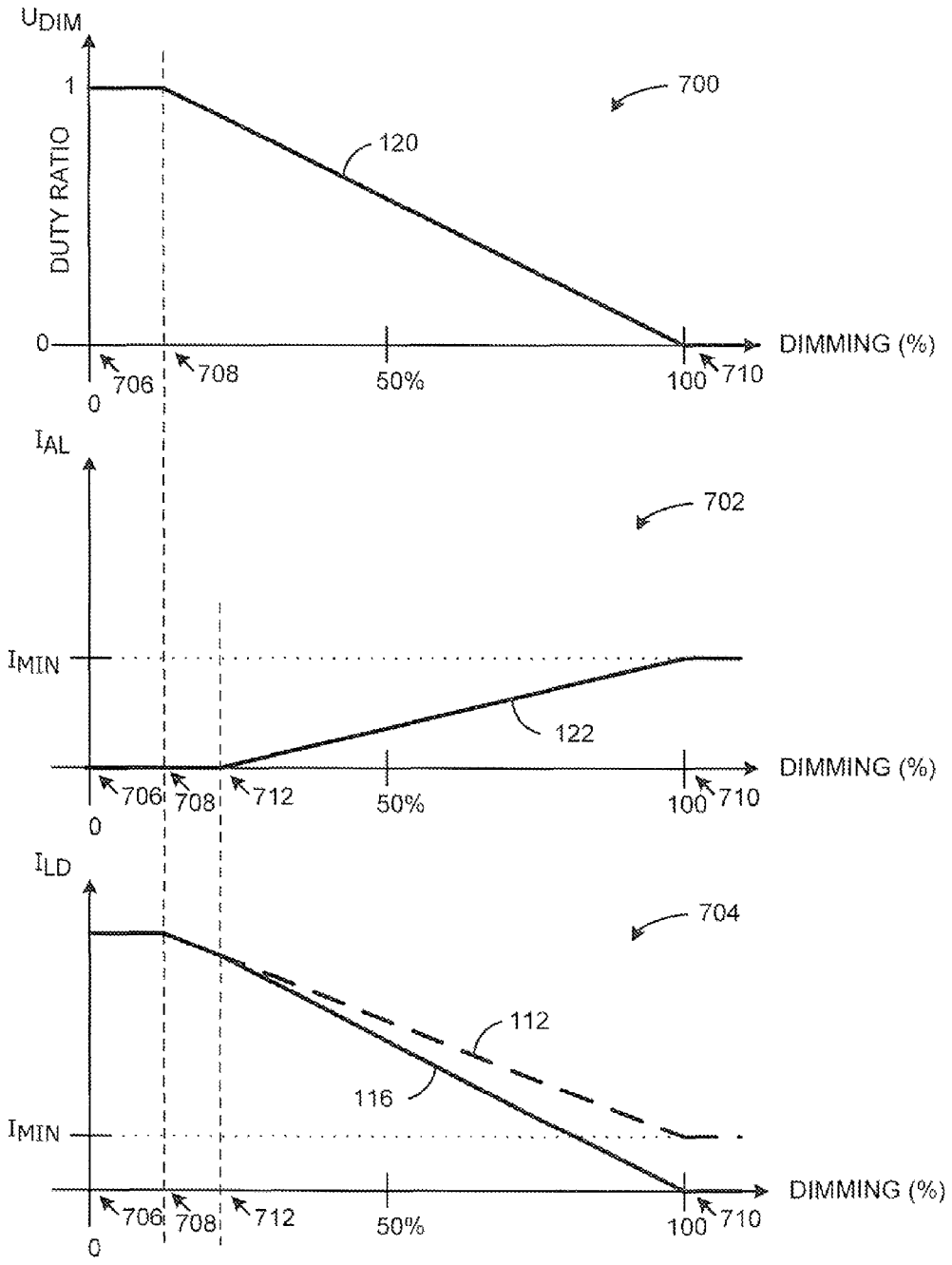
FIG. 7 depicts other example waveforms of a dimming control signal and resultant waveforms in accordance with the present disclosure.

Referring now to FIG. 7, example waveforms of the dimming control signal UDIM 120 and resultant waveforms (i.e., the active load current IAL 122 and the load current ILD 116) are depicted. The dimming control signal UDIM 120 is depicted at 700, the active load current IAL 122 is depicted at 702, and the output current 112 IO and the load current ILD 116 are depicted at 704.

In this example, the dimming control signal UDIM 120 is a PWM signal rather than an analog voltage signal VDIM as depicted in FIGS. 3 and 5. As shown at 700, the dimming control signal UDIM 120, which is represented as a duty ratio that varies between 0 and 1, decreases in value as the desired dimming increases. More specifically, the dimming control signal UDIM 120 is at duty ratio 1, which designates that no dimming (e.g., zero percent dimming) of the load 104 is desired at time 706. At time 708, the duty ratio of the dimming control signal UDIM 120 begins to decrease in response to the user input 118 until it reaches a duty ratio of zero, which designates maximum dimming (complete or one hundred percent) at time 710. As shown in FIG. 7, the duty ratio of the dimming control signal UDIM 120 linearly decreases with percentage dimming.

As shown, in response to the duty ratio of the dimming control signal UDIM 120 decreasing, the active load current IAL 122 begins to linearly increase after a suitable delay at time 712. The delay ensures that the active load does not conduct at zero percent dimming. For example, the delay corresponds to a duty ratio of 0.9 (or other suitable value) before the active load current IAL begins increasing. As shown, the active load current IAL 122 increases until it reaches the minimum output current threshold of the power converter IMIN at time 710.

In addition, the output current IO 112 and the load current ILD 116 begin to linearly decrease at time 708 in response to the duty ratio of the dimming control signal UDIM 120 decreasing. Between time 708 and time 712, the active load current IAL 122 is substantially zero and the output current IO 112 and the load current ILD 116 decrease at the same rate. As such, the output current IO 112 and the load current ILD 116 are substantially equal. At time 712, the load current ILD 116 begins to decrease at a greater rate than the output current IO 112.

As shown, the output current IO 112 substantially reaches the minimum output current threshold of the power converter IMIN at time 710. As such, the driver circuit 102 (e.g., power converter) can maintain its minimum output current threshold and thus not enter into an auto restart or burst-mode condition (or other similar mode). However, the load current ILD 116, which as noted above is a combination of the output current IO 112 and the active load current IAL 122, substantially reaches zero (or one hundred percent dimming) at time 310. Accordingly, current delivered to the load 104 is substantially zero and thus one hundred percent dimming can be achieved in lighting applications.

Figure 8:
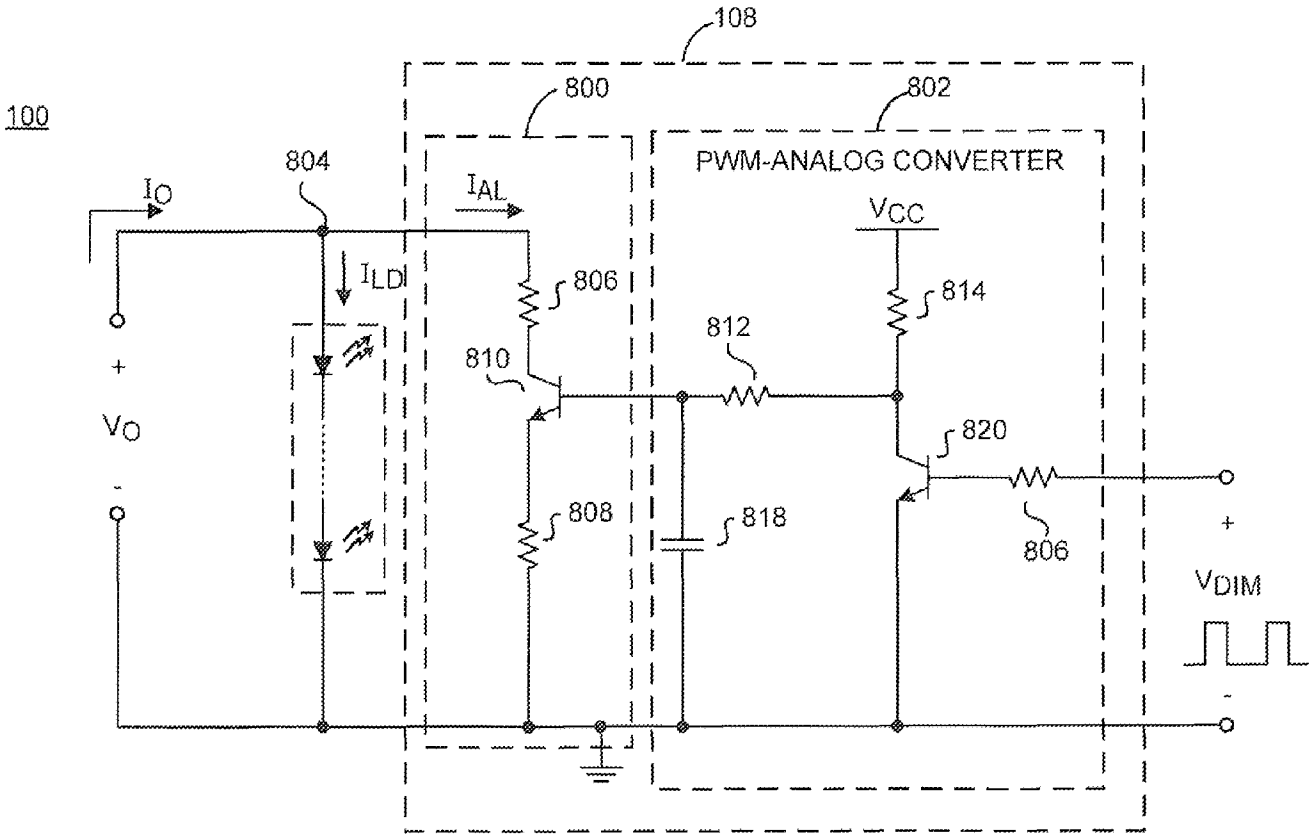
FIG. 8 is an example of the load current management circuit that can be utilized to correspond with the waveforms depicted in FIG. 7.

Referring now to FIG. 8, an example of the load current management circuit 108 is depicted that can be used to correspond with the waveforms of FIG. 7. In this example, the load current management circuit 108 includes signal controlled current source 800 and a PWM-analog converter circuit 802. The PWM-analog converter 802 provides an analog voltage in response to the dimming control signal UDIM 120, which is a pulse width modulated signal VDIM in this example. In response to the analog voltage from the PWM-analog converter 802, the signal controlled current source 800 provides the active load current IAL 122, which is combined with the output current IO 112 at node 804 to provide the load current ILD 116. As noted above, by combining the output current IO 112 and the active load current IAL 122, the load current ILD 116 can be decreased to substantially zero without the driver circuit 102 (e.g., switching power converter) going into an auto restart or similar controller mode (i.e., burst mode at substantially no load condition).

In this example, the signal controlled current source 800 includes a first resistance 806, a second resistance 808, and a transistor 810, such as a BJT for example, substantially configured as shown. The first resistance 806 is used to lessen the dissipation on transistor 810 and thus enable the use of low power transistor. The second resistance 808 is selected such that the current source 800 can deliver the minimum output current IMIN during one hundred percent dimming. The signal controlled current source 800 provides a current in response to a voltage signal or a current signal.

The PWM-analog converter circuit 802 includes a third resistance 812, a fourth resistance 814, a fifth resistance 816, a capacitance 818, and a transistor 820 substantially configured as shown. In this example, the transistor 820 is a BJT however other suitable transistor may be used if desired. In one example, the third resistance 812 can have a resistance of 10 kΩ or other suitable value, the fourth resistance 814 can have a resistance of 10 kΩ or other suitable value, the fifth resistance 816 can have a resistance of 10 kΩ or other suitable value, and the capacitance 818 can have a capacitance of 10 microfarads (g) or other suitable value.

As noted above, among other advantages, the load current management circuit 108 provides the active load current 122 to offset the output current 122 of the driver circuit 102 in response to dimming control signal 120. As such, the load current 116, which is based on a combination of the active load current 122 and the output current 122, can be decreased substantially to zero without the output current 122 reaching the minimum threshold current required by the driver circuit to provide a regulated output current and/or voltage. Other advantages will be recognized by those of ordinary skill in the art.

Although the disclosure is described herein with reference to specific embodiments, various modifications and changes can be made without departing from the scope of the present invention as set forth in the claims below. Accordingly, the specification and figures are to be regarded in an illustrative rather than a restrictive sense, and all such modifications are intended to be included within the scope of the present disclosure. Any benefits, advantages, or solutions to problems that are described herein with regard to specific embodiments are not intended to be construed as a critical, required, or essential feature or element of any or all the claims.

What is claimed is:

1. A circuit comprising:

a switching power converter that is operative to provide a first current in response to a dimming control signal; and a load current management circuit that is operative to provide a second current in response to the dimming control signal, wherein the second current increases as the first current decreases.

2. The circuit of claim 1 wherein the second current decreases as the first current increases.

3. The circuit of claim 1 comprising a load that consumes a third current, wherein the third current is based on the first current and the second current.

4. The circuit of claim 3 wherein the load comprises at least one light emitting diode.

5. The circuit of claim 3 wherein:

the first current varies between a first current value and a second current value based on the dimming control signal;

the second current varies between the second current value and a third current value based on the dimming control signal; and the third current is approximately the first current value when first current is approximately the first current value and the second current is approximately the third current value.

6. The circuit of claim 5 wherein the first current value is greater than the second current value and the second current value is greater than the third current value.

7. The circuit of claim 1 wherein the load current management circuit comprises a signal controlled current source, operatively coupled in parallel to a load, that is operative to provide the second current based on the dimming control signal.

8. The circuit of claim 7 wherein the load current management circuit comprises an inverter circuit, operatively coupled to the signal controlled current source, that is operative to provide an inverted signal based on the dimming control signal.

9. The circuit of claim 7 wherein the load current management circuit comprises a pulse width modulation to analog converter circuit that is operative to provide an analog signal based on a duty ratio of the dimming control signal.

10. The circuit of claim 5 wherein the second current value corresponds to a required minimum load current for the power converter to regulate an output voltage.

11. A circuit comprising:

a switching power converter that is operative to provide a first current that varies between a first current value and a second current value in response to a dimming control signal; and a load current management circuit that is operative to provide a second current that varies between the second current value and a third current value in response to the dimming control signal, wherein the second current varies in accordance with the first current.

12. The circuit of claim 11 wherein the second current increases as the first current decreases.

13. The circuit of claim 11 wherein the second current decreases as the first current increases.

14. The circuit of claim 11 wherein the second current value corresponds to a required minimum load current for the power converter to regulate an output voltage.

15. The circuit of claim 11 comprising a load that consumes a third current, wherein the third current is based on the first current and the second current.

16. The circuit of claim 15 wherein the load comprises at least one light emitting diode.

17. The circuit of claim 11 wherein the load current management circuit comprises a signal controlled current source, operatively coupled in parallel to a load, that is operative to provide the second current based on the dimming control signal.

18. The circuit of claim 17 wherein the load current management circuit comprises an inverter circuit, operatively coupled to the signal controlled current source, that is operative to provide an inverted signal based on the dimming control signal.

19. The circuit of claim 17 wherein the load current management circuit comprises a pulse width modulation to analog converter circuit that is operative to provide an analog signal based on a duty ratio of the dimming control signal.

20. The circuit of claim 11 wherein the second current value corresponds to a required minimum load current for the power converter to regulate an output voltage.

* * * * *